US005669203A

United States Patent [19]

Müller

[11] Patent Number: 5,669,203

[45] Date of Patent: Sep. 23, 1997

[54] CARTON ACTIVATING MECHANISM

[75] Inventor: Rolf Müller, Mehring, Germany

[73] Assignee: Riverwood International Corporation, Atlanta, Ga.

[21] Appl. No.: 545,896

[22] Filed: Oct. 20, 1995

[30] Foreign Application Priority Data

Oct. 20, 1994 [GB] United Kingdom ..... 9421189

[51] Int. Cl.[6] ..... B65B 21/00; B65B 21/24; B65B 27/04

[52] U.S. Cl. ..... 53/398; 53/48.7; 53/48.9

[58] Field of Search ..... 53/48.1, 48.7, 53/48.8, 48.9, 398, 387.2, 382.2

[56] References Cited

U.S. PATENT DOCUMENTS

| | | | |
|---|---|---|---|
| 3,045,401 | 7/1962 | Ganz | 53/48.9 |
| 4,285,185 | 8/1981 | Collura et al. | 53/48.7 |
| 4,554,778 | 11/1985 | Calvert | 53/48.7 X |
| 4,612,753 | 9/1986 | Taylor et al. | 53/398 |
| 4,970,843 | 11/1990 | Louret et al. | 53/48.9 X |

FOREIGN PATENT DOCUMENTS 0 200 445 11/1986 European Pat. Off. .

*Primary Examiner*—Horace M. Culver
*Attorney, Agent, or Firm*—Isaf, Vaughan & Kerr

[57] ABSTRACT

A carton activating mechanism (26) for opening the gatefold seats of a paperboard carton blank (13) is disclosed. A rotatable disc (30) carries a spaced series of activators (34), each of which includes a plate (35) having a pair of pivotally-connected fingers (37). The plate is reciprocably mounted on the disc by a pin (36) received in a groove (32) defined on a stationary plate (31) positioned with respect to the disc. Each of the fingers has a projection (40) and a cooperating abutment (41) so that the respective fingers are moved outwardly into an extended position, and then spread apart into an open position to fold the gatefold seats of the carton blank before closing and being retracted from the gatefold seats of the carton blank.

16 Claims, 11 Drawing Sheets

CARTON ACTIVATING MECHANISM

FIELD OF THE INVENTION

This invention relates to carton activating mechanisms for use with cartons having a gatefold article retaining seat spanning a folded junction between two main panels of the carton.

BACKGROUND OF THE INVENTION

In the blank, for a carton having a gatefold article retaining seat spanning a folded junction between two main panels of the carton, each retaining seat has two tab panels which are spaced apart, or are disposed on either side of a cut which is generally perpendicular to, and which preferably spans, the folded junction. Each tab panel is divided by a fold line extending toward the cut or space from the fold line between the two main panels at an angle relative to the fold, with each tab panel being hinged to the main panels by angled fold lines. In other types of this carton, there is a sub-panel between the two main panels. Where a sub-panel is provided, the angled fold line of each tab panel extends from one of the fold lines between the main panels and the sub-panel. When the main panels are hingedly moved toward each other, the tab panels form retaining seats for articles such as bottles in the angle between the main panels. FIGS. 1A and 1B show a pair of suitable blanks for such a seat, and FIGS. 2A and 2B show a plan view of one seat and an end view of another seat.

SUMMARY OF THE INVENTION

According to the present invention there is provided a mechanism for activating a gatefold article seat of a carton having a pair of fingers which are movable between a withdrawn position and a projecting position in which they engage and push back the two tab panels of the seat at one side of the angled fold lines dividing the tab panels, respectively, the mechanism also spreading apart said fingers for a predetermined time while in said projecting position so as to bend back the two tab panels while at the same time a folding device engages the main panel at the other side of the angled fold lines so as to bend the two panels relative to each other such that the gatefold seat adopts its configuration.

In a preferred embodiment a number of pairs of fingers are provided at spaced locations on a rotating disc so as to engage successive pairs of tab panels in a sequential manner. The locations may be equally spaced for a non-pitched machine, or in spaced groups according to pack size and pitch in a pitched machine. Conveniently the disc and the operation of the fingers are driven in synchronization with the main packing machine drive.

Preferably, each pair of fingers is moved between its withdrawn and projecting positions by means of a follower engaged in a stationary guide groove. In one embodiment, each follower is secured on a carrier plate which carries its associated pair of fingers. It is a further preferred feature that each pair of fingers is provided with outwardly projecting portions at their inner ends, which portions engage stops when in the projecting position so as to spread apart the outer ends of the fingers by deflecting the inner ends inwards about individual pivot points. Ideally said stops are provided on said disc.

In another preferred embodiment the folding device comprise a plurality of guide surfaces which progressively fold the panels relative to each other. In another embodiment the folding device comprises kicking elements which are also mounted on the disc and comprise a tangentially extending bar for each pair of fingers so that the bar swings into and out of its active position through a second follower which follows a stationary cam surface.

In the preferred embodiments, the leading edge of each pair of fingers is generally pointed to facilitate the pushing back of the tab panels of the gatefold seat.

According to another aspect of the present invention there are provided two such mechanisms disposed on opposite sides of an article packaging device which mechanisms operate on gatefold seats at opposite sides of a carton.

An embodiment of the present invention will now be described, in more detail. The description makes reference to the accompanying drawings.

DETAILED DESCRIPTION

Figure 1A:
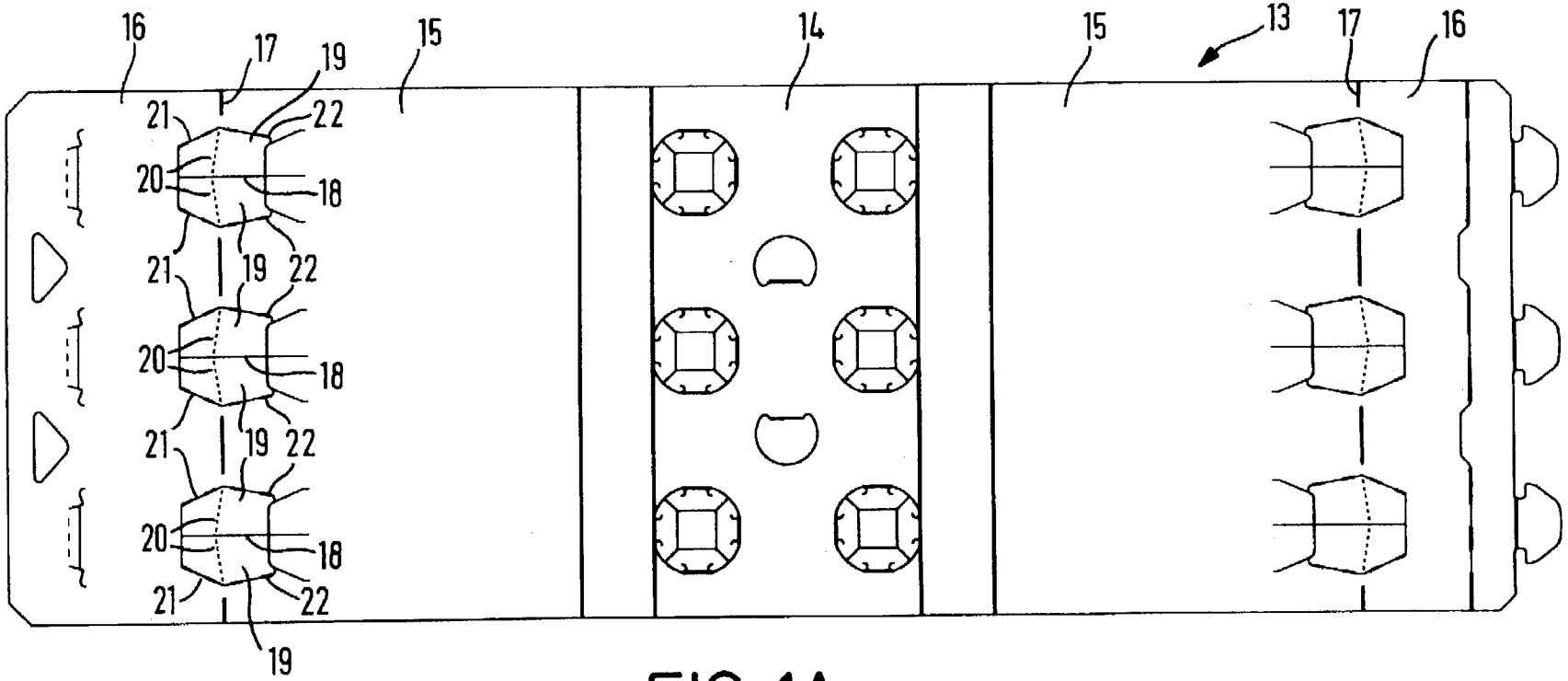
FIGS. 1A and 1B show two blanks for a carton incorporating a gatefold article seat.
Figure 1B:
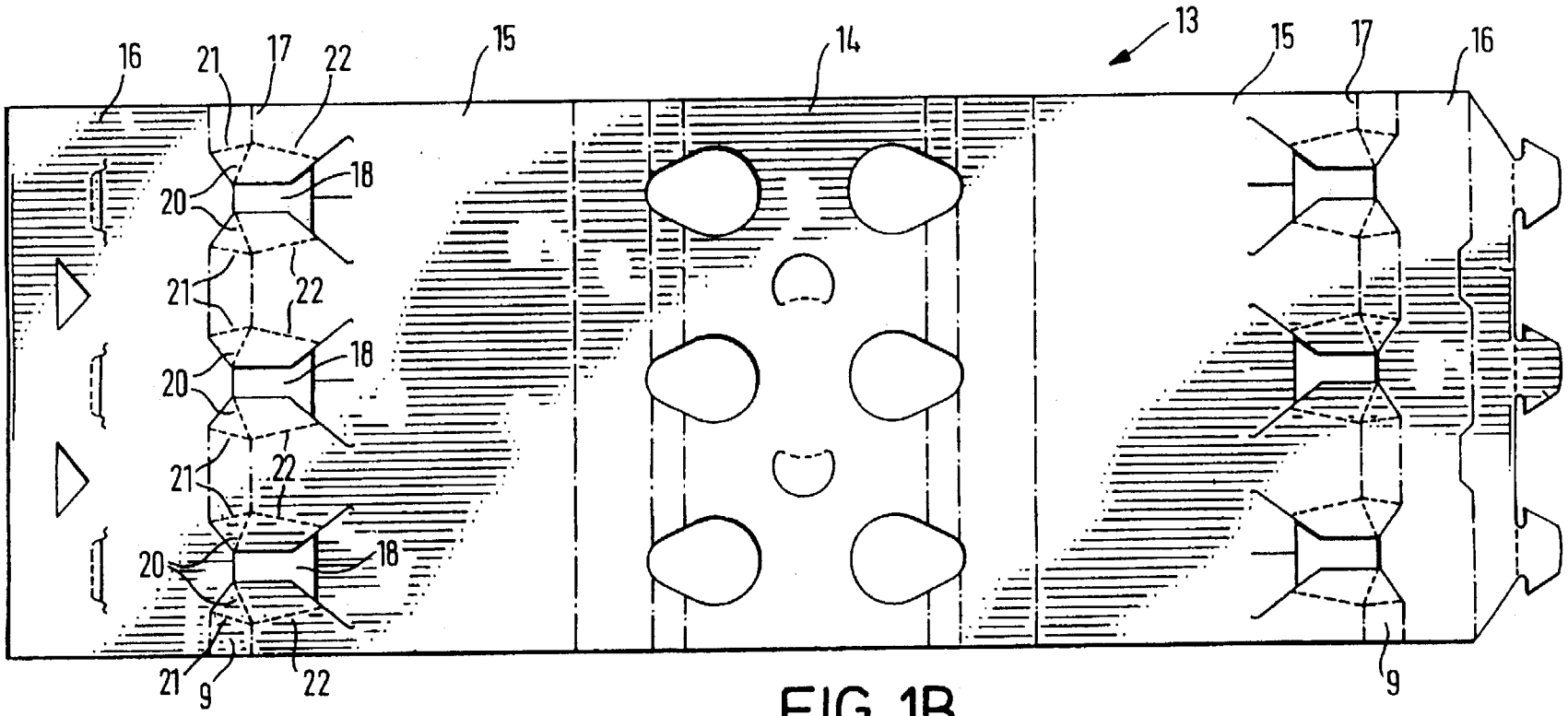
Figure 2:
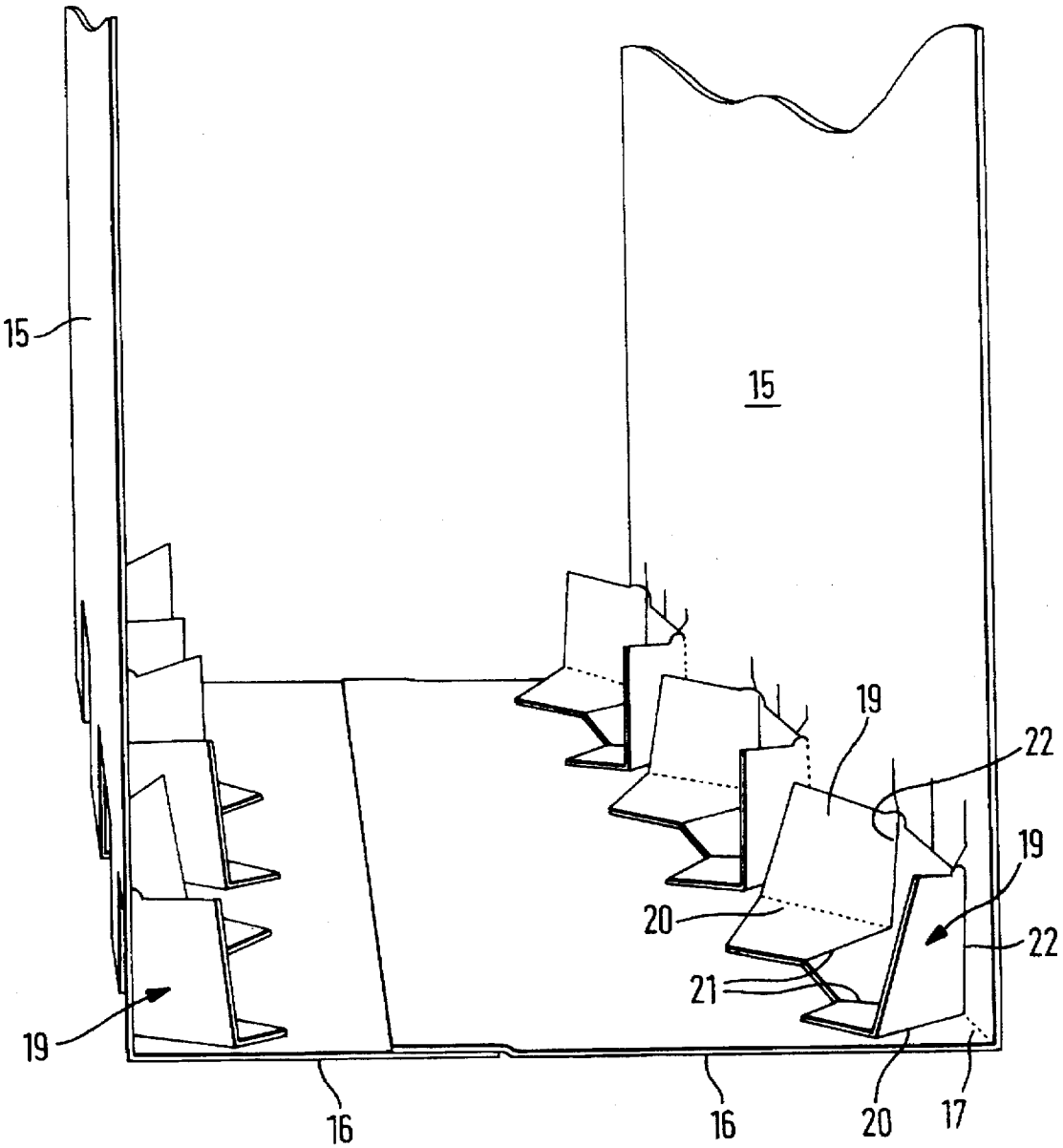
FIG. 2 is a partially cut away perspective end view of a gatefold article seat made from the carton blank of FIG. 1A.
Figure 3:
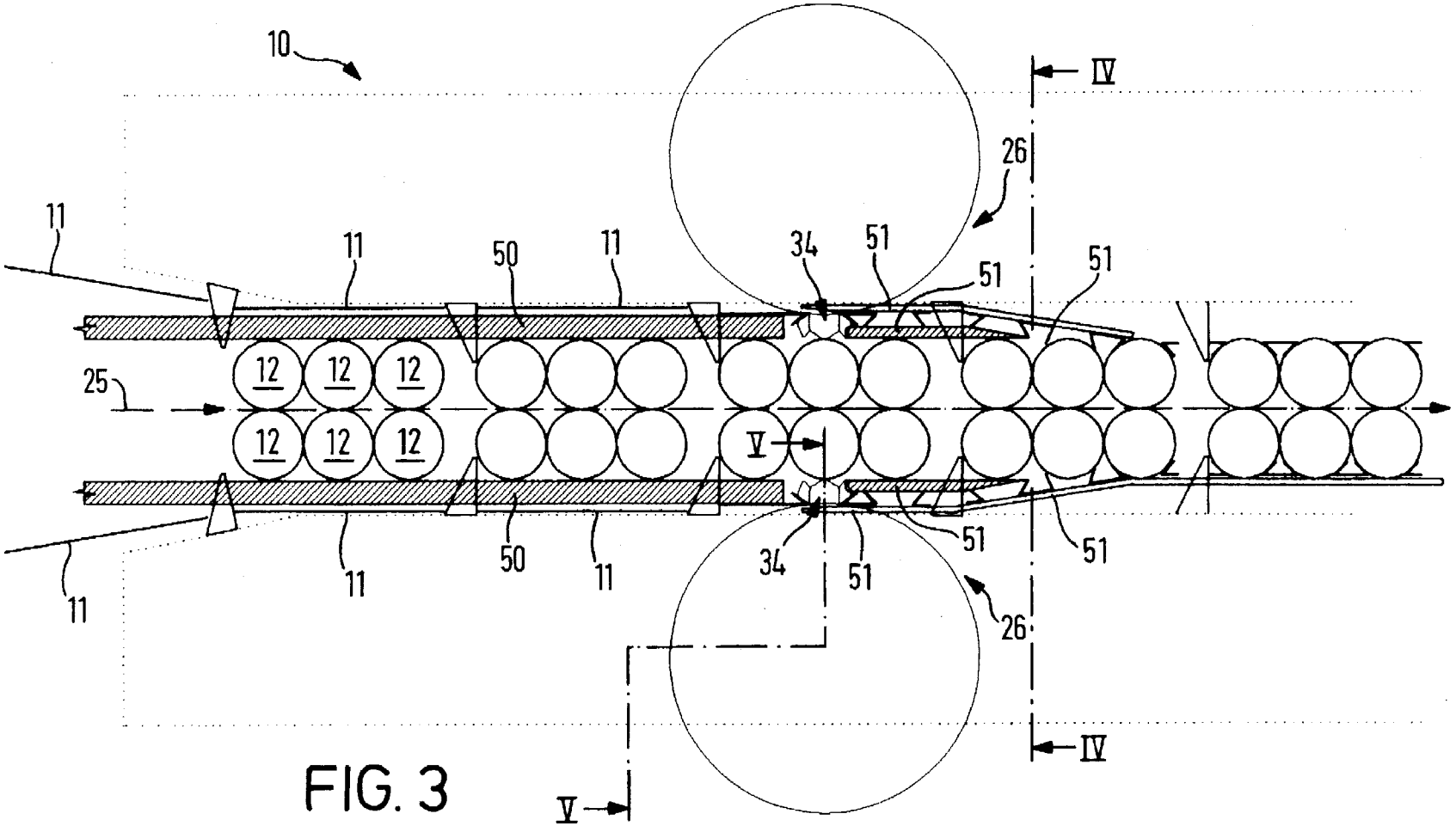
FIG. 3 is a partially cut away top plan view of a mechanism according to the present invention installed in a packaging machine.

In FIG. 3 there is shown part of a machine 10 for wrapping a sleeve 11 around a plurality of articles such as bottles or cans 12. Each sleeve 11 is made from a blank 13 having a top panel 14, two side walls 15 and two interconnecting base panels 16. The junction of each base panel 16 and its associated side wall is by way of a fold 17 or a fold 17 and a sub panel 9 as in FIG. 1B. Where the base 16 and side wall 15 are to engage a bottle, for example, a gatefold seat is provided. Each gatefold seat is formed from two tab panels 19 separated by a vertical cut 18 (or space in FIG. 1B). Each tab panel 19 is divided in two by angled fold lines 20 extending from the fold 17 to the vertical cut. The two parts of each tab panel 19 remain attached to the blank 13 by angled side folds 21, 22. When the tab panels 19 are pushed in and the base 16 bent about the fold 17, the tab panels 19 form a seat for the bottle with the lower portions of the tab panels 19 lying either against the base 16 or at suitable angles to engage portions of the article being held. In use the bottle sits against these lower portions thereby ensuring that the seat remains in position. FIGS. 1 and 2 illustrate this.

The machine 10 has a central can conveyor 25 along which bottles are transferred in groups of 2×2, 2×3, 2×4 or whatever size multipack is to be wrapped. In the embodiment shown the machine is set up for 2×3 multipacks. The blanks 13 are positioned over the groups of bottles and the walls of the blanks manipulated around the bottles. The gatefold seats are activated by an activating mechanism 26 located on each side of the conveyor 25. In the arrangement shown the machine 10 is pitched, such that the bottles for one multipack are fed through one after the other but with a predetermined space between groups. In other arrangements the passages of bottles could by unbroken whilst still being packaged in multipacks.

The gatefold seats require precise technique in order to activate them and of course this technique must be perfectly timed in relation to the passage of bottles through the machine 10. The mechanism 26 is designed to activate the gatefold seats.

The mechanism 26 comprises a disc 30 which is adapted to be rotated about a vertical axis adjacent the conveyor 25. Located below the disc 30 is a plate 31 which is stationary and in which is machined a guide groove 32. The groove 32 is generally circular and centered on the axis of the disc but has an outwardly deformed section 33 in its region adjacent the conveyor 25.

The disc 30 carries a number of activators 34 arranged in four groups of three. The machine 10 is phased and is set up to pack 2×3 multipacks and so the activators are associated respectively with the three gatefold seats of each blank 13. If the machine 10 was not phased, the activators 34 would be provided all around the periphery of the disc.

Each activator comprises a carrier plate 35 mounted for radial sliding movement. Slots are provided to define the path of the sliding movement. A downwardly projecting pin 36 is provided on each plate 35 and the pins engage in the groove 32 in the plate 31. It will be appreciated that most of the time the carrier plates 35 will be in retracted positions but once in each revolution of the disc 30 each carrier plate will be thrust outwardly by virtue of the outwardly deformed section 33 of the guide groove 32.

Each carrier plate 35 carries a pair of fingers 37 which are pivotally connected to the plate 35 by pins 38. When closed together the fingers 37 provide a generally pointed leading area 39. Adjacent the pins 38, each finger 37 has an outward projection 40 for cooperation with abutments 41 formed on the disc on each side of the carrier. For each activator 34 the distance between its pair of abutments 41 is just sufficient for the fingers 37 to pass through. After a certain amount of radial movement of the activator 34, the projections 40 engage the respective abutments 41 and this causes rotation of the fingers 37 about the pins 38. The leading ends of the fingers 37 are thus caused to spread outwards.

As the carrier plate 35 begins to move radially inwards, the side walls 15 of the carton engage the outer surfaces 42 of the fingers 37 such that the fingers rotate back about the pins 38 until the fingers 37 return to their original closed position.

Figure 4:
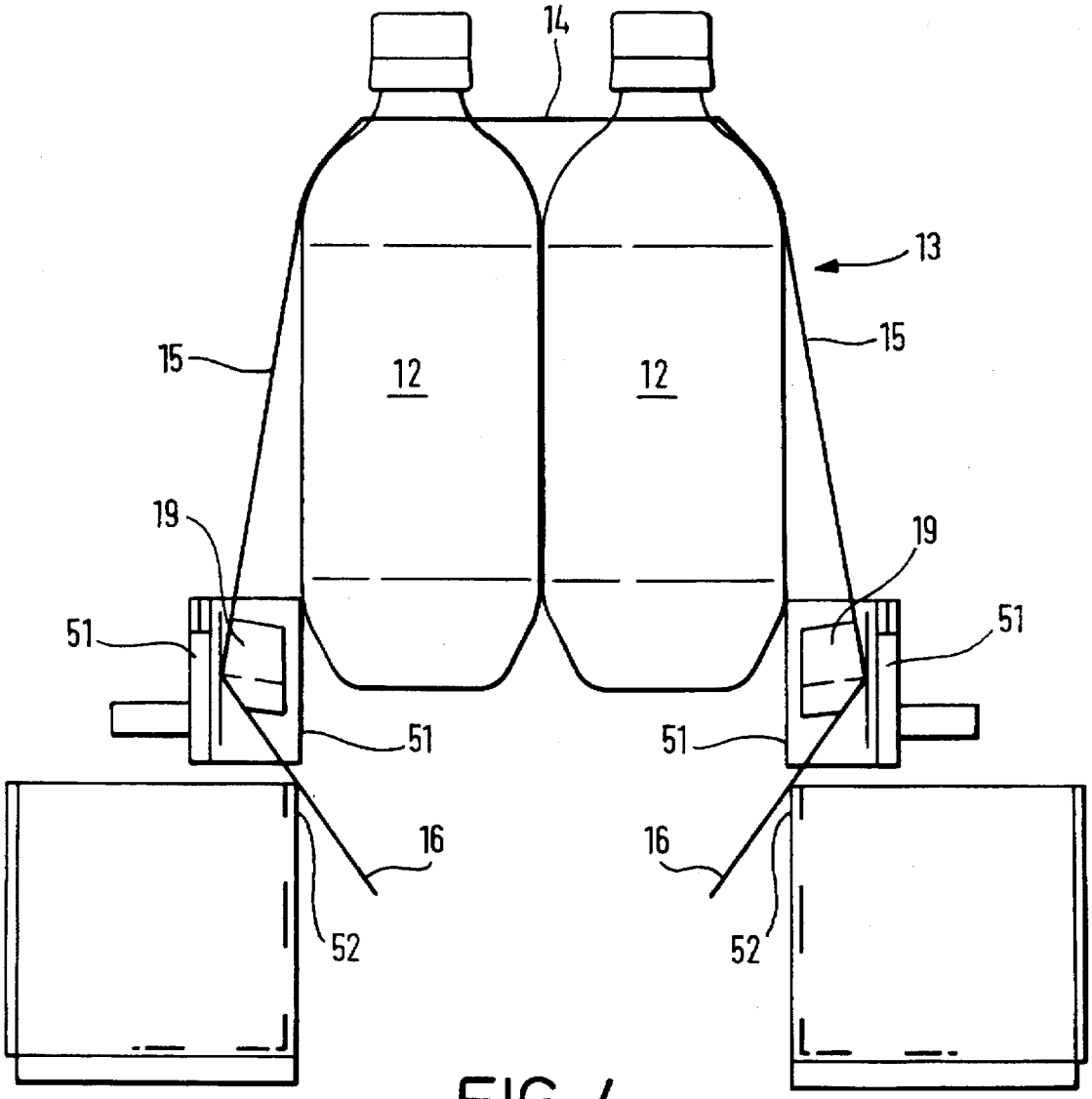
FIG. 4 is a cross sectional view taken on line IV—IV of FIG. 3.
Figure 5:
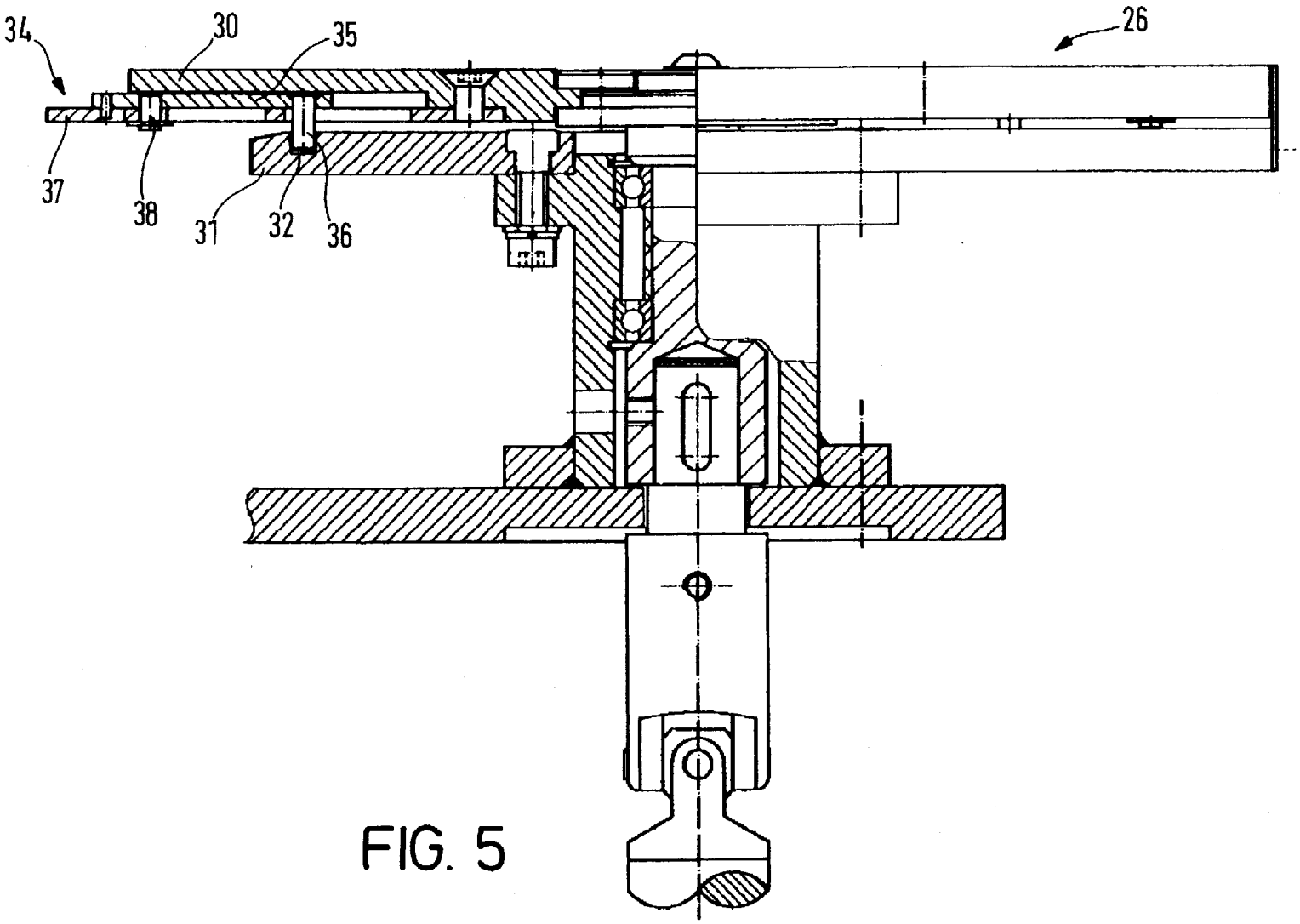
FIG. 5 is a partial cross sectional end view on line V—V of FIG. 3, and FIGS. 6A to 6E illustrate a range of enlarged schematic plan views showing the operation of the fingers used in the mechanism.
Figure 6A:
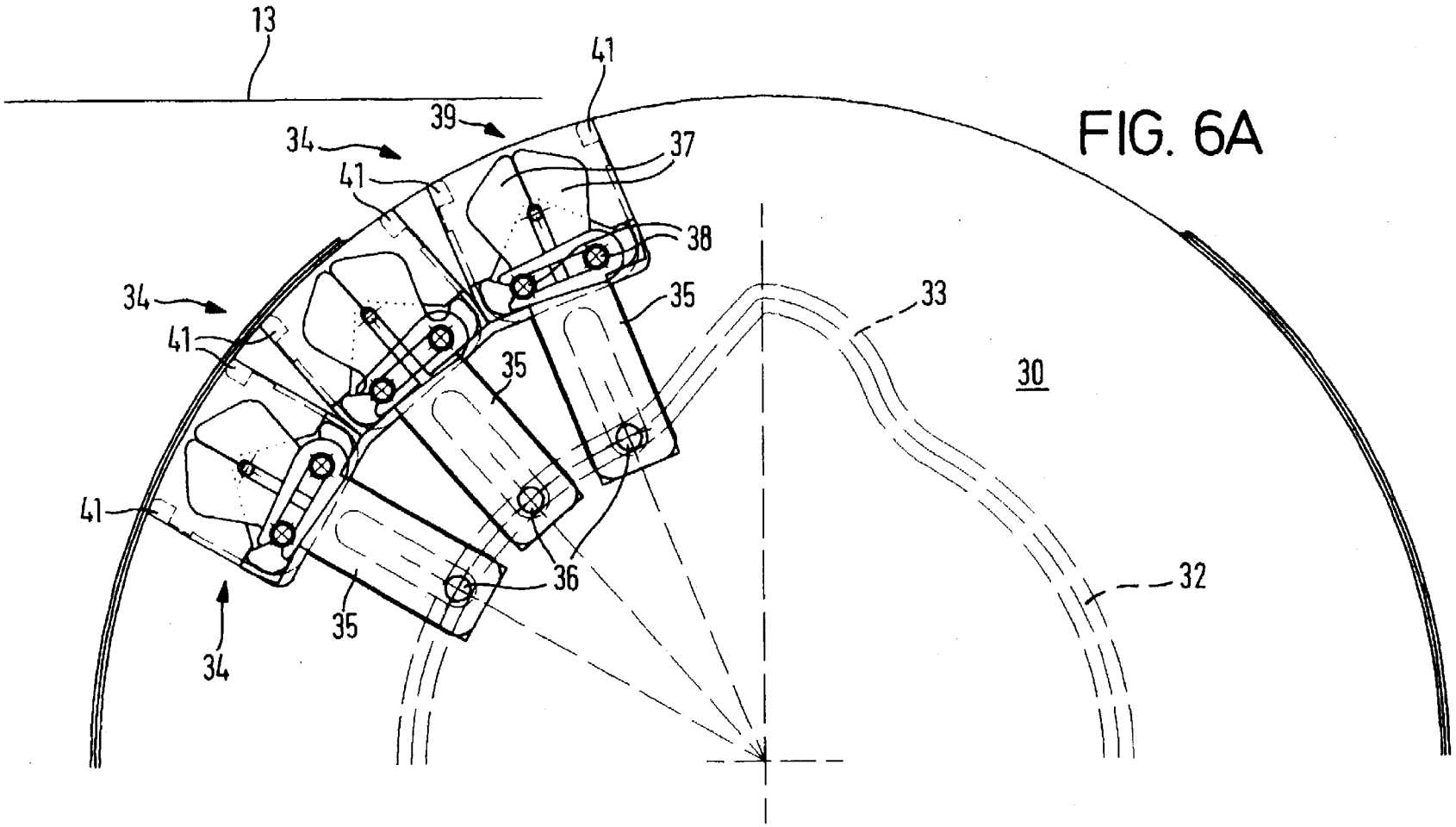
Figure 6B:
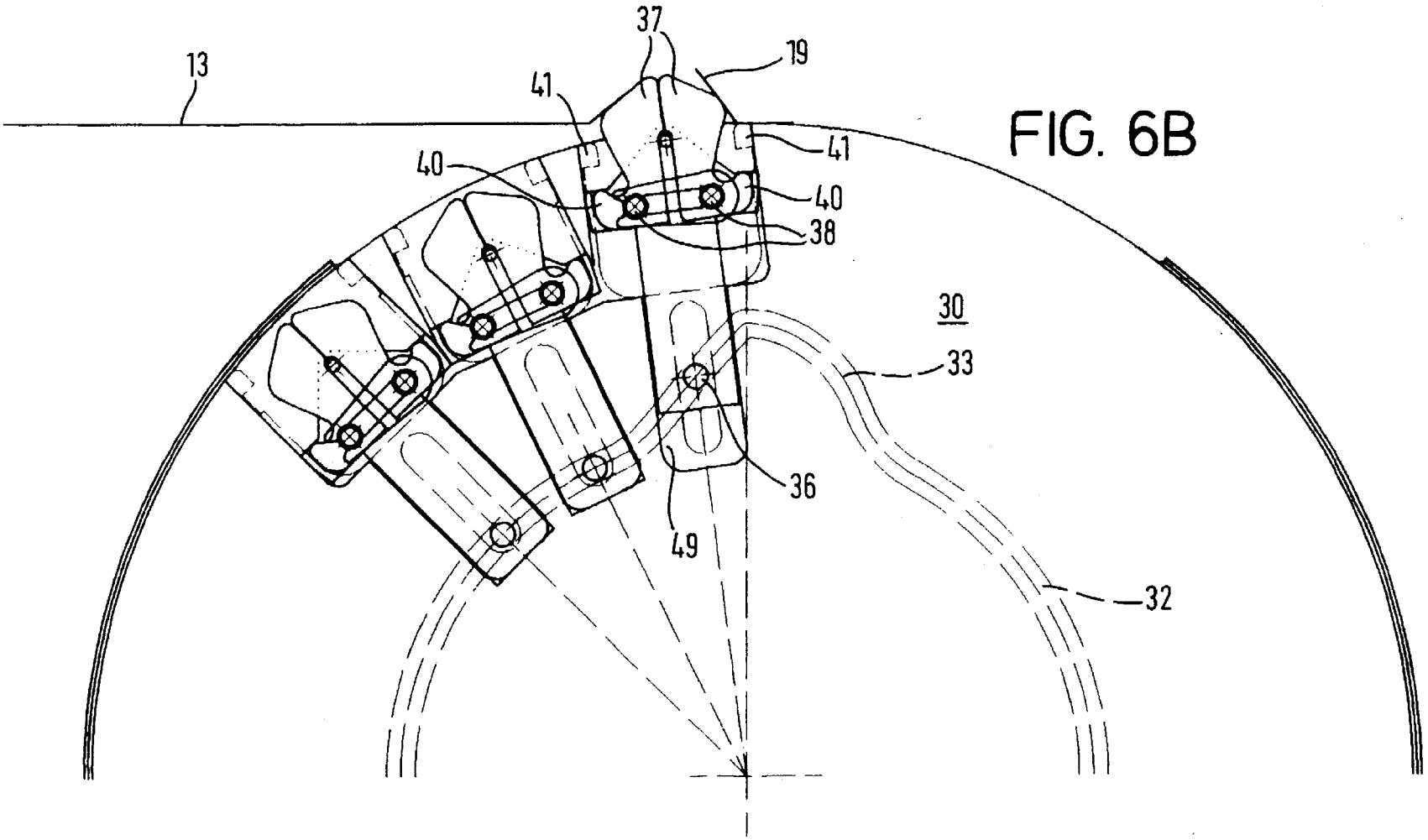
Figure 6C:
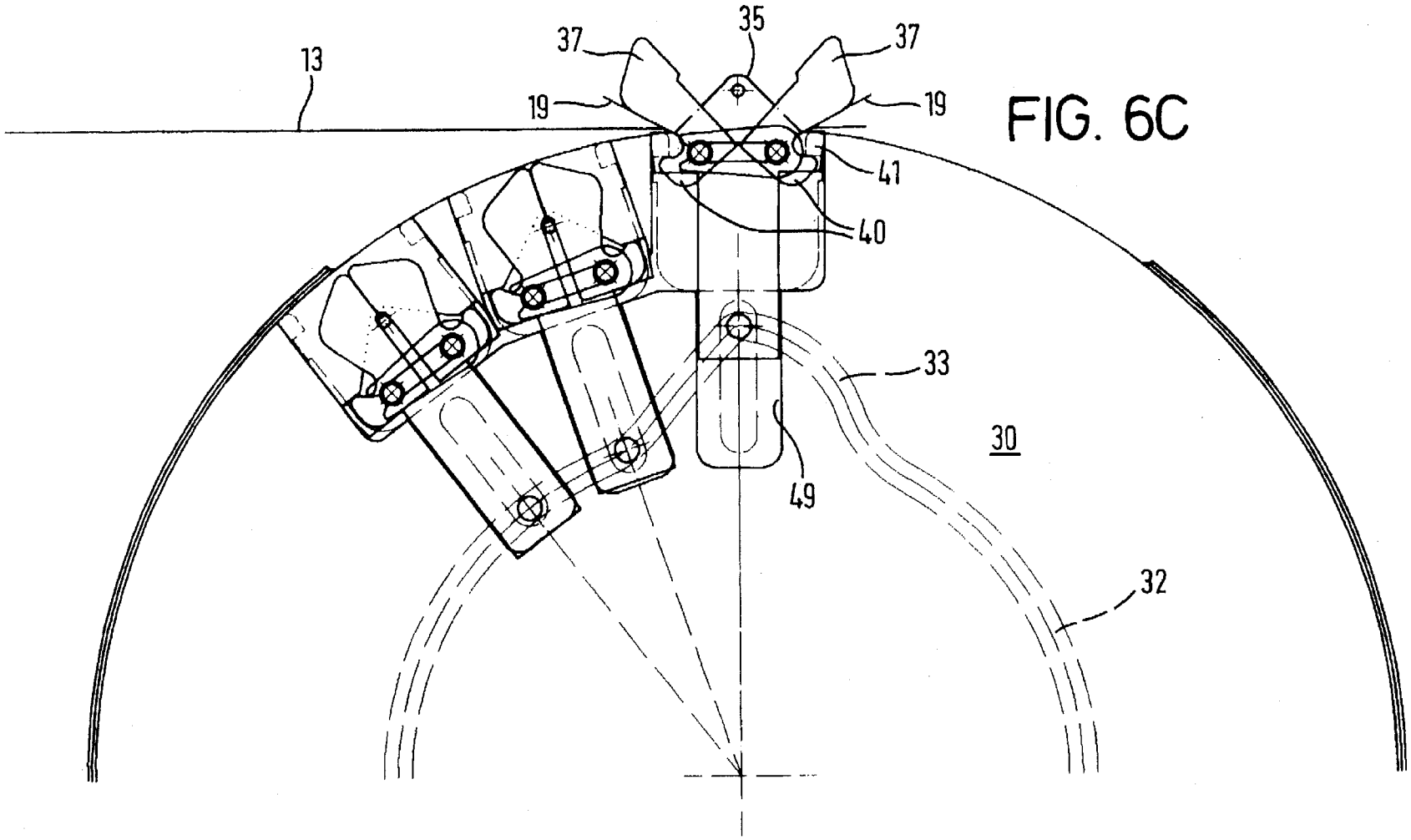
Figure 6D:
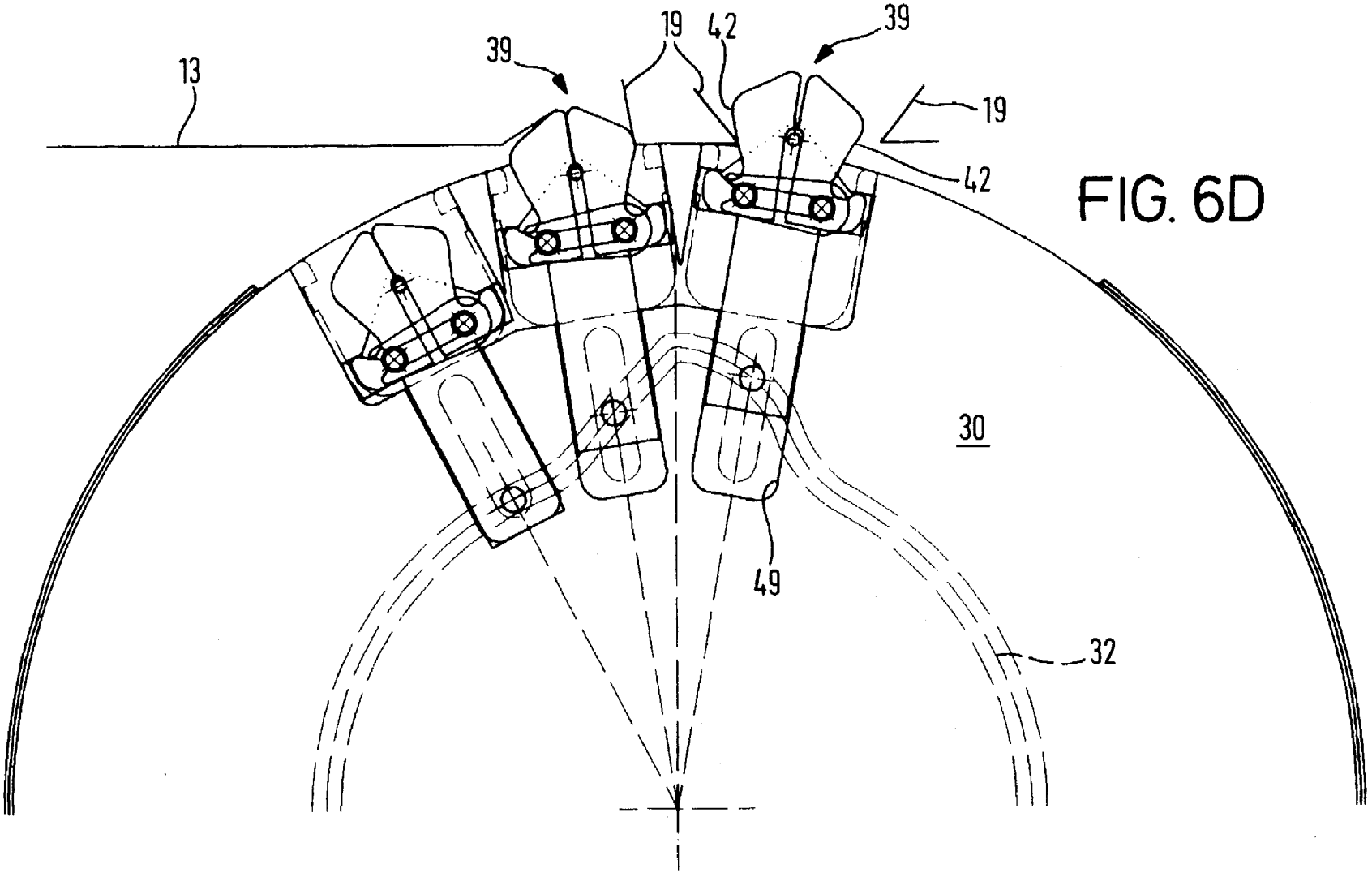
Figure 6E:
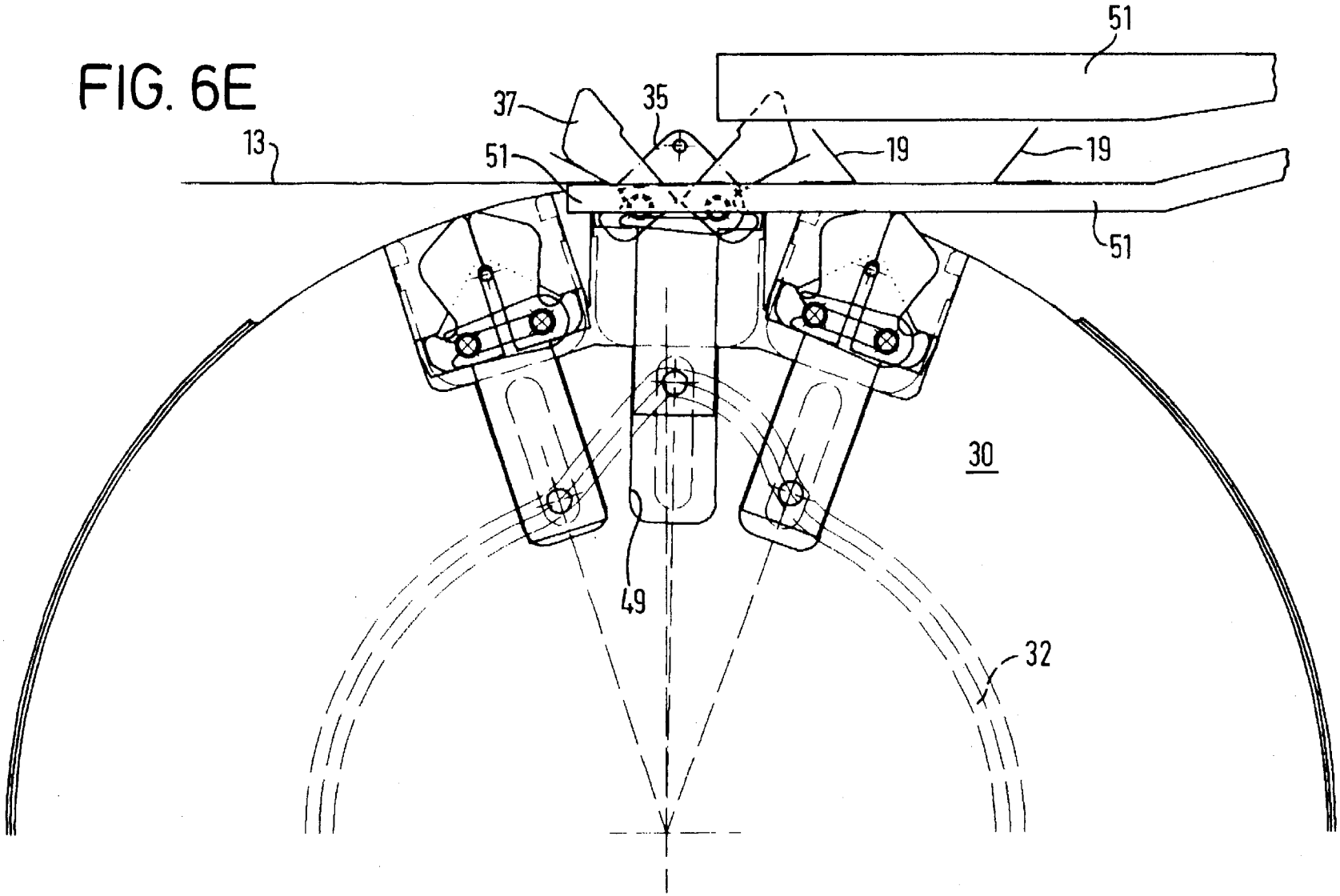

Also included in the mechanism are guide surfaces 50 which support the side walls 15 of the blank when the fingers are inserted. After the tab panels 19 have been bent back the blank 13 passes between guides 51 which hold the side panels 19 in their bent back position whilst a bottom guide 52 engages the base panel 16 and progressively folds the blank into contact with the bottles. To avoid complication, the guides 51 are shown only in FIGS. 3, 4 and 5E, but will be present in FIGS. 6A and 6D.

OPERATION

In use of the mechanisms 26, the rotation of the disc 30 is timed so as to coincide with the passage of bottles. As a group of six bottles begins to pass the mechanism 26 with a blank 13 partially folded over the bottles, the first activator 34 of a group of three is activated. At this point the pin 36 of the first carrier engages the outward section 33 of the groove 32 and the carrier plate 35 with its fingers 37 is pushed forward. The tab panels 19 of the first gatefold seats are engaged and pushed back. Further outward movement of the carrier plate causes the fingers 37 to spread out behind the side wall 15 of the blank by virtue of projections 40 engaging the abutments 41. At the same time as the spreading of the fingers 37, the blank engages the guides 51, 52 which fold the base panel 16 about side wall 15 and retains the seat as it is inserted underneath its bottle. The pin 36 then starts to move inwards thereby closing the fingers 37 before withdrawing the fingers 37 and carrier plate 35. Before this stage has been completed however the second activator has begun its working cycle on the second gatefold seat of the blank 13. This is repeated for the third activator of the set of three with the final gatefold seat of the black 13. As the disc 30 continues to rotate, the next blank 13 is manipulated by the next group of three activators 34 in concert with 51, 52.

It will also be appreciated that other methods of guiding the activators 34 are possible. Also, the geometry and form of the fingers and carrier plates could be manipulated. Also it will be readily apparent that the numbers of activators per disc and the groupings (or lack of them) are a matter of design choice.

The guides 51, 52 could also be replaced by kicking bars which could engage the base panel from below. In one envisaged arrangement, each bar extends tangentially relative to the disc 30 and is pivotally connected to the disc by means of a link element. The link elements rest against a cam surface which is shaped such that for most of the revolution of the disc the bars are lowered. However, adjacent the conveyor the cam surface has an outward deformation which causes the bar to kick upwards and engage the base panel 16 of the blank. Other methods of ensuring the fold are envisaged.

While a preferred embodiment of the invention has been disclosed in the foregoing specification and drawings, it will be understood by those skilled in the art that variations and modifications thereof may be made without departure from the spirit and scope of the invention as set forth in the following claims.

I claim:

1. A mechanism for folding spaced gatefold article seats of a carton blank into an activated article receiving position as the carton blank is advanced along a path of travel through a packaging machine, each gatefold article seat having a pair of tab panels hingedly connected to a side wall of the carton blank along side fold lines, and an angled fold line dividing each tab panel for folding the respective tab panels therealong into the activated position, and a base panel hingedly connected to each of the tab panels and to the side wall of the carton blank, said mechanism comprising:

a rotating disc positioned with respect to the carton blank;

a spaced series of pairs of fingers positioned on at least a portion of the periphery of said disc, the fingers of each of said pairs of fingers sequentially engaging the tab panels of successive ones of the gatefold article seats as the carton blank advances along the path of travel;

the fingers of each said pair of fingers being movable between a withdrawn position with respect to the gatefold article seats of the carton blank, and a projecting position in which the fingers of each said pair of fingers engage and bend the tab panels of the gatefold article seat inwardly of the carton blank along the side fold lines for each such tab panel;

said mechanism being constructed and arranged to spread apart the fingers of each of said pairs of fingers for a predetermined period of time as the fingers are in said projecting position while a folding means simultaneously engages the base panel of the carton blank so as to fold the tab panels relative to each other along their respective angled fold lines such that the respective gatefold article seats adopt an activated configuration.

2. The mechanism as claimed in claim 1, wherein said spaced pairs of fingers are spaced equally from one another along at least a portion of the periphery of said disc.

3. The mechanism as claimed in claim 1, wherein said spaced pairs of fingers are spaced in a series of spaced groups of pairs of fingers along at least a portion of the periphery of said disc.

4. The mechanism as claimed in claim 1, wherein said rotating disc and the movement of the fingers of said pairs of fingers from said withdrawn position to said projecting position are driven in synchronization with the operation of said packaging machine.

5. The mechanism as claimed in claim 1, wherein the fingers of each said pair of fingers are moved between said withdrawn position and said projecting position, respectively, by a follower formed as a part of each said pair of fingers, said follower being engaged in a stationary guide groove positioned with respect to said disc.

6. The mechanism as claimed in claim 5, wherein each said follower is fastened to a carrier plate, said carrier plate being constructed and arranged to carry an associated one of said pairs of fingers therewith.

7. The mechanism as claimed in claim 6 wherein each finger of each of said pairs of fingers includes an outwardly projecting abutment at an inner end thereof, each respective one of said abutments being constructed and arranged to separately engage a stop when said pairs of fingers are in said projecting position so as to spread the fingers apart from one another by deflecting said inner ends inwardly of the carton blank about an individual pivot point for each finger.

8. The mechanism as claimed in claim 7, wherein one of said stops is mounted on said disc with respect to each finger of said pairs of fingers.

9. The mechanism as claimed in claim 1, wherein said folding means comprises a plurality of guide surfaces constructed and arranged to progressively fold the tab panels of the carton blank along the angled fold lines thereof.

10. The mechanism as claimed in claim 1, wherein said folding means further comprises a kicking element for each said pair of fingers, said kicking element being mounted on said disc and including a tangentially extending bar constructed and arranged to reciprocably swing into and out of an active position with respect to the carton blank in response to the movement of a second follower engaged in a second stationary groove positioned with respect to said disc.

11. The mechanism as claimed in claim 1, wherein each finger of said pairs of fingers has a leading edge, said leading edge being generally pointed for pushing the tab panels of the gatefold article seat inwardly of the carton blank.

12. The mechanism of claim 1, wherein said mechanism is disposed on a first side of the path of travel, and further comprising an opposed and identical second one of said mechanisms disposed on a second side of the path of travel.

13. A method of folding spaced gatefold article seats of a carton blank into an activated article receiving position as the carton blank is advanced along a path of travel through a packaging machine, each gatefold article seat having a pair of tab panels hingedly connected to a side wall of the carton blank along side fold lines, and an angled fold line dividing each tab panel for folding the respective tab panels therealong into the activated position, and a base panel hingedly connected to each of the tab panels and to the side wall of the carton blank, said method comprising the steps of:

positioning a disc with respect to the carton blank;

rotating said disc in the direction of the path of travel;

providing a spaced series of pairs of fingers along at least a portion of the periphery of said disc;

sequentially moving the fingers of each respective one of said pairs of fingers from a withdrawn position with respect to the tab panels of the gatefold article seat into a projecting position in engagement with the tab panels of successive ones of the gatefold article seats as the carton blank advances along the path of travel;

spreading the fingers of each respective one of said pairs of fingers in said projecting position apart for a predetermined period of time and bending the tab panels of the gatefold article seat inwardly of the carton blank along the side fold lines in response thereto; and simultaneously engaging a folding means with the base panel of the carton blank and folding the base panel with respect to the side wall of the carton blank while also folding the tab panels along their respective angled fold lines so that the respective gatefold article seats are moved into the activated configuration.

14. The method of claim 13, comprising the step of rotating said disc in timed relationship with the movement of a group of articles advancing along the path of travel.

15. The method of claim 13, wherein the step of spreading the fingers of each respective one of said pairs of fingers in said projecting position apart comprise the steps of:

positioning a stop with respect to each finger of each of said pairs of fingers;

providing an abutment on an outside edge of each finger of each said pair of fingers;

moving the abutment of each finger into engagement with one of said stops as said pair of fingers is moved into said projecting position; and pivoting one of the ends of each finger about a pin holding the other end of each finger to a carrier plate in response thereto.

16. A mechanism for folding spaced gatefold article seats of a carton blank into an activated article receiving position as the carton blank is advanced along a path of travel through a packaging machine, each gatefold article seat having a pair of tab panels hingedly connected to a side wall of the carton blank along side fold lines, and an angled fold line dividing each tab panel for folding the respective tab panels therealong into the activated position, and a base panel hingedly connected to each of the tab panels and to the side wall of the carton blank, said mechanism comprising:

a disc for being rotated in the direction of the path of travel;

a stationary plate, said stationary plate being parallel to and spaced from said disc;

a continuous groove having a predetermined cam profile defined in a surface of said plate facing said disc;

a spaced series of pairs of fingers positioned on at least a portion of the periphery of said disc;

said spaced pairs of fingers being mounted on a separate carrier plate for each said pair of fingers, each said carrier plate being carried on said disc and having a guide pin depending therefrom, each said guide pin being slidably engaged in said groove;

said carrier plates being constructed and arranged to be moved on said disc between a withdrawn position with respect to the periphery of said disc and a projecting position in which the fingers of each said pair of fingers project radially beyond the periphery of said disc for engaging the tab panels of the respective gatefold article seats, the fingers being constructed and arranged to be spread apart from one another in said projecting position for a predetermined period of time for bending the tab panels inwardly of the carton blank with respect to the side wall thereof; and at least one guide positioned with respect to said disc and being constructed and arranged to fold the base panel with respect to the side wall of the carton blank while also folding the tab panels along their respective angled fold lines so that the respective gatefold article seats are moved into the activated configuration.

* * * * *